US008603212B2

(12) United States Patent
Kawano et al.

(10) Patent No.: US 8,603,212 B2
(45) Date of Patent: Dec. 10, 2013

(54) IRON-BASED MIXED POWDER FOR POWDER METALLURGY

(75) Inventors: Takashi Kawano, Chiba (JP); Shigeru Unami, Chiba (JP); Tomoshige Ono, Chiba (JP); Yukiko Ozaki, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/320,391

(22) PCT Filed: May 27, 2010

(86) PCT No.: PCT/JP2010/059402

§ 371 (c)(1), (2), (4) Date: Jan. 13, 2012

(87) PCT Pub. No.: WO2010/137735

PCT Pub. Date: Dec. 2, 2010

(65) Prior Publication Data

US 2012/0111146 A1 May 10, 2012

(30) Foreign Application Priority Data

May 28, 2009 (JP) ..... 2009-129706
May 26, 2010 (JP) ..... 2010-120175

(51) Int. Cl.
*B22F 1/00* (2006.01)

(52) U.S. Cl.
USPC ..... 75/252

(58) Field of Classification Search
USPC ..... 75/229, 231, 232, 235, 252, 246; 419/19, 23, 24
See application file for complete search history.

(56) References Cited

U.S. PATENT DOCUMENTS

| | | | | |
|---|---|---|---|---|
| 3,357,818 | A | 12/1967 | Findeisen | |
| 4,230,491 | A * | 10/1980 | Behnke | 75/243 |
| 4,255,193 | A | 3/1981 | Slesar et al. | |
| 4,599,110 | A | 7/1986 | Kohler et al. | |
| 4,808,205 | A * | 2/1989 | Hughes et al. | 65/134.6 |
| 5,080,712 | A * | 1/1992 | James et al. | 75/229 |
| 5,135,566 | A * | 8/1992 | Sakuranda et al. | 75/255 |
| 5,256,184 | A * | 10/1993 | Kosco et al. | 75/246 |
| 5,682,595 | A | 10/1997 | Gonseth et al. | |
| 5,766,304 | A | 6/1998 | Uenosono et al. | |
| 6,375,709 | B1 | 4/2002 | Storstrom et al. | |
| 6,602,315 | B2 * | 8/2003 | Hendrickson et al. | 75/255 |
| 2005/0095163 | A1 | 5/2005 | Yoshihiro et al. | |

FOREIGN PATENT DOCUMENTS

| | | |
|---|---|---|
| JP | A-55-54547 | 4/1980 |
| JP | A-60-218403 | 1/1985 |
| JP | A-3-64402 | 3/1991 |
| JP | A-03-131526 | 6/1991 |
| JP | A-06-136404 | 5/1994 |
| JP | A-06-256801 | 9/1994 |
| JP | A-07-188803 | 7/1995 |
| JP | A-08-325667 | 12/1996 |
| JP | A-09-287002 | 11/1997 |
| JP | A-2001-059147 | 3/2001 |
| JP | A-2002-8913 | 1/2002 |
| JP | A-2002-515542 | 5/2002 |
| JP | A-2004-339598 | 12/2004 |
| JP | A-2005-105368 | 4/2005 |
| JP | A-2006-213984 | 8/2006 |
| JP | A-2007-031744 | 2/2007 |
| JP | A-2008-127640 | 5/2008 |
| WO | WO 2009/075042 | 6/2009 |

OTHER PUBLICATIONS

International Search Report in International Application No. PCT/JP2010/059402; dated Jul. 27, 2010 (with English-language translation).
International Preliminary Report on Patentability dated Dec. 12, 2011 for International Patent Application No. PCT/JP2010/059402 (with translation).
International Preliminary Report on Patentability dated Feb. 14, 2012 for International Patent Application No. PCT/JP2010/061297 (with translation).
International Search Report dated Oct. 12, 2010 issued in International Patent Application No. PCT/JP2010/061297 (with translation).
U.S. Appl. No. 13/377,396.
Dec. 6, 2012 Office Action issued in U.S. Appl. No. 13/377,396.
May 13, 2013 Office Action issued in U.S. Appl. No. 13/377,396.

* cited by examiner

*Primary Examiner* — Roy King
*Assistant Examiner* — Ngoclan T Mai
(74) *Attorney, Agent, or Firm* — Oliff & Berridge, PLC

(57) ABSTRACT

In an iron-based powder, 0.01% to 5.0% by mass of a flaky powder having an average particle size of longitudinal size of 100 or less, a thickness of 10 μm or less, and an aspect ratio (longitudinal size-to-thickness ratio) of 5 or more with respect to the iron-based mixed powder is contained, whereby the flowability of an iron-based mixed powder is increased, the density of a green compact is increased, and ejection force is greatly reduced after compaction, thereby accomplishing an increase in product quality and a reduction in production cost.

9 Claims, 1 Drawing Sheet

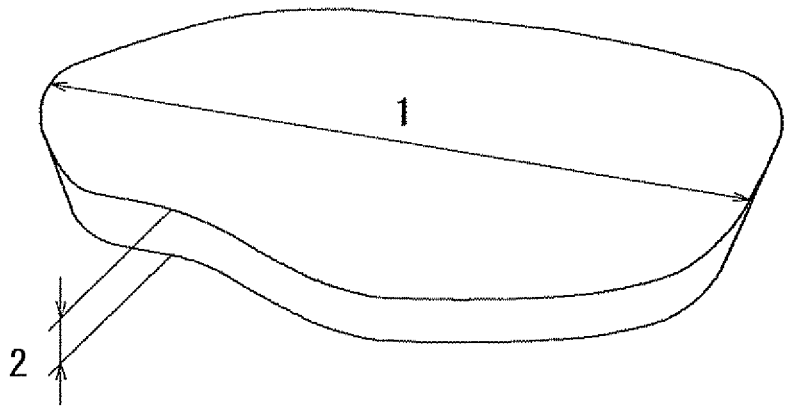
1
2

IRON-BASED MIXED POWDER FOR POWDER METALLURGY

TECHNICAL FIELD

The present invention relates to an iron-based mixed powder suitable for use in powder metallurgy. In particular, the present invention is intended to increase green density and is also intended to advantageously reduce the ejection force necessary to withdraw a green compact from a die after compaction.

BACKGROUND ART

In a powder metallurgy process, source powders are mixed together; the mixture is transferred, is filled into a die, and is then pressed into a formed body (hereinafter referred to as a green compact); and the green compact is withdrawn from the die and is then subjected to a post-treatment such as sintering as required.

In the powder metallurgy process, in order to achieve an increase in product quality and a reduction in production cost, it is necessary to ensure all of high powder flowability in a transferring step, high compressibility in a pressing step, and low ejection force in a step of withdrawing the green compact from the die.

As for techniques for improving the flowability of iron-based mixed powders, PTL 1 discloses that the flowability of an iron-based mixed powder can be improved by adding a fullerene thereto.

PTL 2 discloses a technique for improving the flowability of powder by adding a particulate inorganic oxide with an average particle size of less than 500 nm thereto.

However, the use of these techniques is insufficient to ensure high compressibility and low ejection force while flowability is maintained.

In order to increase the density of a green compact or in order to reduce the ejection force thereof, it is effective to use a lubricant that has ductility and that is soft at a temperature at which an iron-based mixed powder is pressed. This is because the lubricant seeps out of the iron-based mixed powder during pressing to adhere to a surface of a die and therefore reduces the friction between the die and the green compact.

However, the lubricant has ductility and therefore is likely to adhere to particles of an iron powder and powder for an alloy. Hence, there is a problem in that the flowability and filling ability of iron-based mixed powder are impaired.

The blending of the above carbon material, fine particles, and lubricant reduces the theoretical density (supposing that the voidage is zero) of the iron-based mixed powder to cause a reduction in green density; hence, it is not preferable to blend large amounts of these materials.

It has been extremely difficult to balance the flowability of a conventional iron-based mixed powder, high green density, and low ejection force.

RELATED ART DOCUMENT

PTL 1: Japanese Unexamined Patent Application Publication No. 2007-31744

PTL 2: PCT Japanese Translation Patent Publication No. 2002-515542

SUMMARY OF INVENTION

Problems to be Solved by the Invention

The present invention has been developed in view of the aforementioned circumstances and has an object to provide an iron-based mixed powder for powder metallurgy. The iron-based mixed powder can accomplish both an increase in product quality and a reduction in production cost in such a way that the density of a green compact is increased by increasing the flowability of the iron-based mixed powder and ejection force is greatly reduced after compaction.

Solution to Problem

In order to achieve the above object, the inventors have investigated various additives for iron-based powders.

As a result, the inventors have found that the addition of an appropriate amount of a flaky powder to an iron-based powder provides excellent flowability and also provides significantly improved green density and ejection force.

The present invention is based on the above finding.

The present invention is as summarized below.

1. An iron-based mixed powder for powder metallurgy contains an iron-based powder and 0.01% to 5.0% by mass of a flaky powder having an average particle size of longitudinal size of 100 μm or less, a thickness of 10 μm or less, and an aspect ratio (longitudinal size-to-thickness ratio) of 5 or more with respect to the iron-based mixed powder.
2. In the iron-based mixed powder for powder metallurgy specified in Item 1, the flaky powder comprises at least one selected from the group consisting of silica, calcium silicate, alumina, and iron oxide.
3. The iron-based mixed powder for powder metallurgy specified in Item 1 or 2 further contains powder for an alloy.
4. The iron-based mixed powder for powder metallurgy specified in any one of Items 1 to 3 further contains an organic binder.
5. The iron-based mixed powder for powder metallurgy specified in any one of Items 1 to 4 further contains a free lubricant powder.

Advantageous Effects of Invention

According to the present invention, excellent flowability, high green density, and low ejection force can be achieved by adding an appropriate amount of a flaky powder to an iron-based powder. This results in an increase in production efficiency and a reduction in production cost.

BRIEF DESCRIPTION OF DRAWINGS

FIG. 1 is a schematic view of a flaky powder according to the present invention.

DESCRIPTION OF EMBODIMENTS

The present invention will now be described in detail.

A flaky powder used herein refers to a powder comprising tabular particles in which the size in the thickness direction is extremely less than the size in the spread direction. In the present invention, as shown in FIG. 1, the flaky powder contains primary particles having an average particle size of longitudinal size 1 of 100 μm or less, a thickness 2 of 10 μm or less, and an aspect ratio (longitudinal size-to-thickness ratio) of 5 or more.

In a step of compression-molding an iron-based mixed powder, the flaky powder can reduce the friction between powders due to the rearrangement or plastic deformation of the powders and the friction between a die and the powders to accomplish an increase in green density. In a step of withdrawing a compaction, ejection force can be greatly reduced through the reduction in friction between a green compact and the die. These effects are probably due to that the flaky powder is effectively rearranged in the iron-based mixed powder because of the flat shape of the flaky powder to effectively prevent the direct contact between metal powders and the direct contact between the die and the metal powders and reduces the friction therebetween.

The flaky powder preferably comprises an oxide. Examples of the oxide include scaly silica (Sunlovely™, produced by AGC Si-Tech Co., Ltd.), petal-like calcium silicate (FLORITE™, produced by Tokuyama Corporation), tabular alumina (SERATH™, produced by KINSEI MATEC CO., LTD.), and scaly iron oxide (AM-200™, produced by Titan Kogyo, Ltd.). Components thereof or the crystal structure thereof is not particularly limited.

Conventionally known graphite powders are sometimes flaky (flaky graphite and the like), but they cannot accomplish an object of the present invention because improvements cannot be achieved by the addition thereof (see EXAMPLES). The reason therefor is not clear but is probably that graphite has high adhesion to iron powders, iron green compacts, and dies and inhibits the improvement of properties expected in the present invention. Flaky powders made of metals or semimetals like graphite probably adhere to dies and the like and therefore are excluded from the flaky powder specified herein. In other words, flaky powders made of materials other than metals or semimetals do not have an impediment, that is, adhesion to dies and the like, and therefore can be expected to provide effects of the present invention. According to investigations made by the inventors, the following powders are preferred: flaky powders made of substances in which bonds between atoms are principally covalent bonds or ionic bonds and which have relatively low electronic conductivity. The above oxide is particularly preferred. In particular, the oxide is preferably at least one of silica, calcium silicate, alumina, and iron oxide.

Flaky graphite powders are excluded from the flaky powder specified herein because of the above reason. In this regard, however, the addition of a graphite powder as powder for an alloy is allowed regardless of whether the graphite powder is flaky or not.

When the aspect ratio of the flaky powder is less than 5, the above effects cannot be achieved. Therefore, in the present invention, the aspect ratio of the flaky powder is limited to 5 or more. The aspect ratio thereof is more preferably 10 or more and further more preferably 20 or more.

The aspect ratio thereof is measured by a method below. Particles of the oxide are observed with a scanning electron microscope, 100 or more of the particles are selected at random and are measured for longitudinal size 1 and thickness 2, and the aspect ratio of each particle is calculated. Since the aspect ratio has a distribution, the average thereof is defined as the aspect ratio.

In the present invention, an acicular powder can be cited as an example of the flaky powder. The acicular powder is a powder containing needle- or rod-shaped particles. The effects obtained by the addition of the flaky powder are greater than those obtained by the addition of the acicular powder.

When the average particle size of longitudinal size of the flaky powder exceeds 100 μm, the flaky powder cannot be uniformly mixed with an iron-based mixed powder (an average particle size of about 100 μm) usually used for powder metallurgy and therefore the flaky powder cannot exhibit the above effects.

Thus, the average particle size of longitudinal size of the flaky powder needs to be 100 μm or less. The average particle size thereof is more preferably 40 μm or less and further more preferably 20 μm or less.

The average particle size of the flaky powder is defined as the average of the longitudinal sizes 1 observed with the scanning electron microscope. Alternatively, the following size may be used: the particle size at 50% of the cumulative volume fraction in the particle size distribution determined by a laser diffraction-scattering method in accordance with JIS R 1629.

When the thickness of the flaky powder exceeds 10 μm, it cannot exhibit the above effects. Thus, the thickness of the flaky powder needs to be 10 μm or less. The thickness of the flaky powder is effectively 1 μm or less and more preferably 0.5 μm or less. The minimum of the thickness thereof is about 0.01 μm in practical use.

In the present invention, when the amount of the flaky powder blended with the iron-based mixed powder falls below 0.01% by mass, the effects due to the addition of the flaky powder are not obtained. However, when the amount thereof exceeds 5.0% by mass, a significant reduction in green density is caused, which is not preferred. Thus, the amount of the blended flaky powder is 0.01% to 5.0% by mass and more preferably 0.05% to 2.0% by mass.

In the present invention, the following powders are examples of an iron-based powder: pure iron powders such as atomized iron powders and reduced iron powders, diffusion alloyed steel powders, prealloyed steel powders, and hybrid steel powders produced by diffusion alloy components to prealloyed steel powders. The iron-based powder preferably has an average particle size of 1 μm or more and more preferably about 10 μm to 200 μm.

Examples of powder for an alloy include graphite powders; powders of metals such as Cu, Mo, and Ni; and metal compound powders. Other known powders for an alloy also can be used. The strength of a sintered body can be increased by mixing the iron-based powder with at least one of these powders for alloys.

The sum of the contents of these powders for alloys in the iron-based mixed powder is preferably about 0.1% to 10% by mass. This is because when the content of these powders for alloys is 0.1% by mass or more or more than 10% by mass, the strength of an obtained sintered body is advantageously increased or the dimensional accuracy of the sintered body is reduced, respectively.

The powder for an alloy is preferably in such a state (hereinafter referred to as an iron powder with alloy component adhered thereon) that powder for an alloy is attached to the iron-based powder with an organic binder sandwiched therebetween. This prevents the segregation of powder for an alloy and allows components in powder to be uniformly distributed therein.

Herein, an aliphatic amide, a metallic soap, or the like is particularly advantageous and appropriate to the organic binder. Other organic binders such as polyolefins, polyesters, (meth)acrylic polymers, and vinyl acetate polymers can be used. These organic binders may be used alone or in combination. In the case of using two or more the organic binders, at least a part of the organic binders may be used as a composite melt. When the content of the organic binder is less than 0.01% by mass, powder for an alloy cannot be uniformly or sufficiently attached to iron powders. However, when the content thereof is more than 1.0% by mass, the iron powders adhere to each other to aggregate and therefore flowability may possibly be reduced. Thus, the content of the organic binder preferably ranges from 0.01% to 1.0% by mass. The content (mass percent) of the organic binder refers to the percentage of the organic binder in the iron-based mixed powder for powder metallurgy.

In order to improve the flowability and formability of the iron-based mixed powder for powder metallurgy, a free lubricant powder may be added. The content of the free lubricant powder in the iron-based mixed powder for powder metallurgy is preferably 1.0% by mass or less. On the other hand, the content of the free lubricant powder is preferably 0.01% by mass or more. The free lubricant powder is preferably a metallic soap (for example, zinc stearate, manganese stearate, lithium stearate, or the like), a bis amide (for example, ethylene bis-stearamide or the like), an aliphatic amide (for example, monostearamide, erucamide, or the like) including an monoamide, an aliphatic acid (for example, oleic acid, stearic acid, or the like), a thermoplastic resin (for example, an polyamide, polyethylene, polyacetal, or the like), which has the effect of reducing the ejection force of a green compact. A known free lubricant powder other than the above free lubricant powder can be used.

The content of iron in the iron-based mixed powder is preferably 50% by mass or more.

A method for producing the iron-based mixed powder according to the present invention is described below.

The iron-based powder is mixed with the flaky powder according to the present invention and additives such as a binder and a lubricant (a free lubricant powder and/or a lubricant attached to an iron powder with a binder) and is further mixed with powder for an alloy as required. The additives, such as the binder and the lubricant, need not be necessarily added to the iron-based powder at once. After primary mixing is performed using a portion of additives, secondary mixing may be performed using the rest thereof.

A mixing method is not particularly limited. Any conventionally known mixer can be used. The following mixer can be used: for example, an impeller type mixer (for example, a Henschel mixer or the like) or a rotary mixer (for example, a V-type mixer, a double-cone mixer, or the like), which is conventional known. When heating is necessary, the following mixer is particularly advantageous and appropriate: a high-speed mixer, a disk pelletizer, a plough share mixer, a conical mixer, or the like, which is suitable for heating.

In the present invention, an additive for property improvement may be used in addition to the above additives according to purpose. For example, a powder, such as MnS, for machinability improvement is exemplified for the purpose of improving the machinability of a sintered body.

EXAMPLES

Example 1

Prepared iron-based powders were two types: Pure Iron Powder A (an atomized iron powder with an average particle size of 80 μm) and iron powder with alloy component adhered thereon B prepared by attaching powders for alloys to this pure iron powder with organic binders sandwiched therebetween. The powders, for alloys, used for B were 2.0% by mass of a Cu powder (an average particle size of 25 μm) and 0.8% by mass of a graphite (an average particle size of 5.0 μm and an aspect ratio of more than 5). The organic binders used were 0.05% by mass of monostearamide and 0.05% by mass of ethylene bis-stearamide. The percentage of each of these additives is a proportion to corresponding iron-based powder.

The iron-based powders were mixed with flaky powders and free lubricant powders at various ratios, whereby iron-based mixed powders for powder metallurgy were obtained. The free lubricant powders used were zinc stearate, ethylene bis-stearamide, and erucamide of which the amounts were as shown in Table 1 in addition to 0.1% by mass of lithium stearate.

For comparison, powders were prepared by adding a flaky graphite powder, a fullerene powder, fine alumina particles, or fine magnesia particles to the iron-based powders. The fullerene powder used was a commercially available powder, containing primary particles with a diameter of 1 nm, having an agglomerate size of about 20 μm. The percentage of each of these mixed powders is shown in Table 1. The percentage thereof is a proportion to each iron-based mixed powder for powder metallurgy.

Each obtained iron-based mixed powder was filled in a die and was then pressed at room temperature with a pressure of 980 MPa, whereby a cylindrical green compact (a diameter of 11 mm and a height of 11 mm) was obtained. In this operation, the flowability of the iron-based mixed powder, the ejection force needed to withdraw the green compact from the die, and the density of the green compact were measured. The measurement results are shown in Table 1. The flowability of the iron-based mixed powder was evaluated in accordance with JIS Z 2502.

Herein, the flowability is good when the fluidity is not more than 30 seconds per 50 grams, the compressibility is good when the green density is 7.35 $Mg/m^3$ or more, and the drawability is good when the ejection force is 20 MPa or less.

TABLE 1

| | | Flaky powder** | | | | | | Free lubricant powder | | Properties | | | |
|---|---|---|---|---|---|---|---|---|---|---|---|---|---|
| No. | Type of iron-based powder* | Type | Shape | Average particle size of longitudinal size (μm) | Thickness (μm) | Aspect ratio | Content (% by mass) | Type | Content (% by mass) | Flowability (sec/50 g) | Green density ($Mg/m^3$) | Ejection force (MPa) | Remarks |
| 1 | B | Calcium silicate | Flaky | 1.0 | 0.05 | 20 | 0.03 | Zinc stearate | 0.4 | 24.3 | 7.37 | 19 | Example 1 |
| 2 | A | Calcium silicate | Flaky | 1.0 | 0.05 | 20 | 0.2 | Erucamide | 0.1 | 22.3 | 7.41 | 17 | Example 2 |
| 3 | B | Alumina | Flaky | 2.0 | 0.06 | 33 | 0.1 | Ethylene bis-stearamide | 0.4 | 24.8 | 7.36 | 18 | Example 3 |

TABLE 1-continued

| No. | Type of iron-based powder* | Flaky powder** Type | Shape | Average particle size of longitudinal size (μm) | Thickness (μm) | Aspect ratio | Content (% by mass) | Free lubricant powder Type | Content (% by mass) | Properties Flowability (sec/50 g) | Green density (Mg/m³) | Ejection force (MPa) | Remarks |
|---|---|---|---|---|---|---|---|---|---|---|---|---|---|
| 4 | B | Alumina | Flaky | 5.0 | 0.08 | 63 | 0.2 | Erucamide | 0.1 | 23.1 | 7.38 | 19 | Example 4 |
| 5 | B | Iron oxide | Flaky | 17 | 0.1 | 171 | 0.2 | Ethylene bis-stearamide | 0.1 | 21.9 | 7.42 | 15 | Example 5 |
| 6 | B | Iron oxide | Flaky | 17 | 0.1 | 171 | 1.0 | Zinc stearate | 0.4 | 23.9 | 7.35 | 17 | Example 6 |
| 7 | B | Silica | Flaky | 5 | 0.05 | 100 | 0.1 | Ethylene bis-stearamide | 0.3 | 24.0 | 7.38 | 18 | Example 7 |
| 8 | B | Alumina | Particulate | 0.05 | 0.05 | 1 | 0.2 | Erucamide | 0.4 | Stagnant | 7.33 | 16 | Comparative Example 1 |
| 9 | B | Iron oxide | Flaky | 180 | 15 | 12 | 0.2 | Erucamide | 0.8 | Stagnant | 7.29 | 45 | Comparative Example 2 |
| 10 | A | Alumina | Flaky | 2.0 | 0.06 | 33 | 0.005 | Erucamide | 1.0 | Stagnant | 7.31 | 25 | Comparative Example 3 |
| 11 | B | Alumina | Flaky | 2.0 | 0.06 | 33 | 6.0 | Zinc stearate | 0.2 | 30.8 | 7.05 | 38 | Comparative Example 4 |
| 12 | B | Flaky graphite | Flaky | 5.0 | 0.1 | 50 | 0.1 | Ethylene bis-stearamide | 0.4 | 21.2 | Unmeasurable | Unmeasurable | Comparative Example 5 |
| 13 | B | Fullerene | Particulate | 0.001 | 0.001 | 0.1 | 0.1 | Ethylene bis-stearamide | 0.4 | 30.7 | 7.21 | 28 | Comparative Example 6 |
| 14 | B | Alumina | Flaky | 10 | 0.4 | 25 | 0.2 | Erucamide | 0.2 | 24.5 | 7.37 | 19 | Example 8 |
| 15 | B | Magnesia | Particulate | 5.0 | 5 | 1 | 0.5 | Zinc stearate | 0.4 | 25.2 | 7.33 | 35 | Comparative Example 7 |
| 16 | B | Iron oxide | Flaky | 33 | 8 | 4 | 0.5 | Erucamide | 0.4 | Stagnant | 7.37 | 32 | Comparative Example 8 |

*A: pure iron powder, B: iron powder with alloy component adhered thereon

**In some of comparative examples, non-flaky powders.

As is clear from Table 1, an iron-based mixed powder excellent in flowability, compressibility, and ejection force can be obtained by the addition of an appropriate amount of a flaky powder according to the present invention. On the other hand, despite the same components, Comparative Example 1, in which a granular fine powder was added, is low in green density and is extremely inferior in flowability to Example 4, in which a flaky powder was added. In Comparative Example 5, in which a component of a flaky powder is graphite, although a mixed powder had high flowability, galling occurred between a green compact and a die during compaction and therefore the green density and ejection force were unmeasurable.

Industrial Applicability

Not only Flowability but also green density and ejection force can be improved, production efficiency can be increased, and production costs can be reduced by adding an appropriate amount of a flaky powder according to the present invention to an iron-based powder.

Explanation of Reference Signs

| | |
|---|---|
| 1 | longitudinal size |
| 2 | thickness |

The invention claimed is:

1. An iron-based mixed powder for powder metallurgy, containing an iron-based powder, an alloying powder, and 0.01% to 5.0% by mass of a flaky powder having an average particle size of longitudinal size of 100 μm or less, a thickness of 10 μm or less, and an aspect ratio (longitudinal size-to-thickness ratio) of 5 or more, wherein the flaky powder comprises oxide particles.

2. The iron-based mixed powder for powder metallurgy according to claim 1, wherein the flaky powder comprises at least one selected from the group consisting of silica, calcium silicate, alumina, and iron oxide.

3. The iron-based mixed powder for powder metallurgy according to claim 1, further containing an organic binder.

4. The iron-based mixed powder for powder metallurgy according to claim 1, further containing a free lubricant powder.

5. The iron-based mixed powder for powder metallurgy according to claim 3, further containing a free lubricant powder.

6. The iron-based mixed powder for powder metallurgy according to claim 2, further containing an organic binder.

7. The iron-based mixed powder for powder metallurgy according to claim 6, further containing a free lubricant powder.

8. The iron-based mixed powder for powder metallurgy according to claim 2, further containing a free lubricant powder.

9. The iron-based mixed powder for powder metallurgy according to claim 1, wherein the alloying powder includes powders containing particles of graphite, Cu, Mo, or Ni.

* * * * *